US008646903B2

(12) United States Patent
Murray et al.

(10) Patent No.: US 8,646,903 B2
(45) Date of Patent: Feb. 11, 2014

(54) PRINTER MEDIA OUTPUT AND INPUT TRAY CONFIGURATION

(75) Inventors: Richard A. Murray, San Diego, CA (US); Siew Pern Chuang, Singapore (SG); George P V, Singapore (SG)

(73) Assignee: Eastman Kodak Company, Rochester, NY (US)

( * ) Notice: Subject to any disclaimer, the term of this patent is extended or adjusted under 35 U.S.C. 154(b) by 349 days.

(21) Appl. No.: 13/070,724

(22) Filed: Mar. 24, 2011

(65) Prior Publication Data

US 2012/0242769 A1 Sep. 27, 2012

(51) Int. Cl.
*B41J 2/01* (2006.01)
*B41J 29/13* (2006.01)

(52) U.S. Cl.
USPC ..... 347/104; 347/108

(58) Field of Classification Search
USPC ..... 347/104, 101, 108; 346/145
See application file for complete search history.

(56) References Cited

U.S. PATENT DOCUMENTS

| | | | | |
|---|---|---|---|---|
| 5,241,353 | A | 8/1993 | Maeshima et al. | |
| 5,464,205 | A * | 11/1995 | Bang | 271/213 |
| 5,711,517 | A * | 1/1998 | Kelly | 271/4.01 |
| 6,382,617 | B1 | 5/2002 | Yen et al. | |
| 6,659,443 | B1 * | 12/2003 | Eskey | 271/9.08 |
| 6,830,401 | B1 | 12/2004 | Hwang et al. | |
| 7,243,915 | B2 | 7/2007 | Wong et al. | |
| 7,905,482 | B2 * | 3/2011 | Matsumoto | 271/213 |
| 8,031,380 | B2 * | 10/2011 | Patterson | 358/474 |
| 8,202,015 | B2 * | 6/2012 | Peck et al. | 400/693 |
| 2002/0180144 | A1 * | 12/2002 | Yamada et al. | 271/292 |
| 2004/0085426 | A1 * | 5/2004 | Cuyler, Jr. | 347/104 |
| 2005/0073569 | A1 * | 4/2005 | Obregon et al. | 347/104 |
| 2005/0094227 | A1 | 5/2005 | Hwang et al. | |
| 2005/0104280 | A1 | 5/2005 | Wong et al. | |
| 2007/0077110 | A1 * | 4/2007 | Bartman | 400/646 |
| 2007/0080495 | A1 * | 4/2007 | Tu | 271/274 |
| 2009/0002965 | A1 | 1/2009 | Peck et al. | |
| 2009/0206539 | A1 * | 8/2009 | Takeuchi et al. | 271/3.14 |
| 2010/0289206 | A1 | 11/2010 | Yoshino et al. | |
| 2011/0101601 | A1 | 5/2011 | Yoda et al. | |

FOREIGN PATENT DOCUMENTS

| | | |
|---|---|---|
| EP | 1 834 797 | 3/2007 |
| WO | 2004/050373 | 6/2004 |

* cited by examiner

*Primary Examiner* — Stephen Meier
*Assistant Examiner* — Leonard S Liang
(74) *Attorney, Agent, or Firm* — Peyton C. Watkins

(57) ABSTRACT

A printing apparatus includes a media input tray including a surface for holding media; and a media output tray including a first edge and a second edge opposite the first edge, the media output tray includes a first position such that the first edge is located at a first distance $h_1$ from the surface of the media input tray and the second edge is located at a second distance $h_2$ from the surface of the media input tray; and a second position such that the first edge is at a third distance $h_3$ from the surface of the media input tray and the second edge is located at a fourth distance $h_4$ from the surface of the media input tray, wherein $h_4>h_2$, $h_4>h_3$, and $h_3>h_1$.

17 Claims, 9 Drawing Sheets

PRINTER MEDIA OUTPUT AND INPUT TRAY CONFIGURATION

FIELD OF THE INVENTION

The present invention relates generally to media handling for a printer, and more particularly to spacing between the media input tray and the media output tray.

BACKGROUND OF THE INVENTION

A printing system typically includes one or more printheads and a paper path including an input tray for loading media, a print region for printing, and an output tray for stacking printed sheets of media. In some types of printers, the printhead has an extent of marking elements that is as wide as the widest type of media that can be accepted by the printer. In such printers, sometimes called page-width printers, the image is printed raster line by raster line as the media is moved relative to the printhead. Although page-width printers can be advantaged for high speed printing, they can be expensive due to the high cost of the page-width printhead.

A common type of printer architecture is the carriage printer, where the printhead marking element array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead is moved by the carriage in a carriage scan direction that is substantially perpendicular to the media advance direction as the marks are made on the recording medium by the printhead. After the printhead has printed a swath of the image while traversing the recording medium, the recording medium is advanced, the carriage direction of motion is reversed, and the image is formed swath by swath.

There are a variety of media path architectures that are known. A so-called "C-shaped" media path having the output tray substantially parallel to the input tray can be advantageous for a compact printer design, and particularly a shorter height printer design. Typically in a C-shaped media path printer, the output tray is located directly over the input tray.

For an output tray that is located close to the input tray, it can be difficult to load media into the input tray. Some printer designs have the output tray mounted on a hinge so that an outward edge of the output tray can be pivoted upward for improved access for media loading into the input tray. U.S. Pat. No. 7,243,915 discloses one example of a hinged output tray that, among its other purposes, provides improved access to the input tray.

To further reduce the height of the printer, in some printers the output tray is spaced very close to the input tray. As a result, even pivoting the output tray about a pivot point away from the input tray does not provide sufficiently easy access to the input tray for media loading.

What is needed is a media tray configuration that facilitates easy access to the input tray for media loading in a printer having a compact design including a close spacing between the input tray and the output tray when the printer is in its operating condition. Furthermore, the way of providing easy access should be low cost, and easy for the user to operate in a reliable fashion.

SUMMARY OF THE INVENTION

A printing apparatus comprising a media input tray including a surface for holding media; and a media output tray including a first edge and a second edge opposite the first edge, the media output tray comprising a first position such that the first edge is located at a first distance $h_1$ from the surface of the media input tray and the second edge is located at a second distance $h_2$ from the surface of the media input tray; and a second position such that the first edge is at a third distance $h_3$ from the surface of the media input tray and the second edge is located at a fourth distance $h_4$ from the surface of the media input tray, wherein $h_4>h_2$, $h_4>h_3$, and $h_3>h_1$.

DETAILED DESCRIPTION OF THE INVENTION

Figure 1:
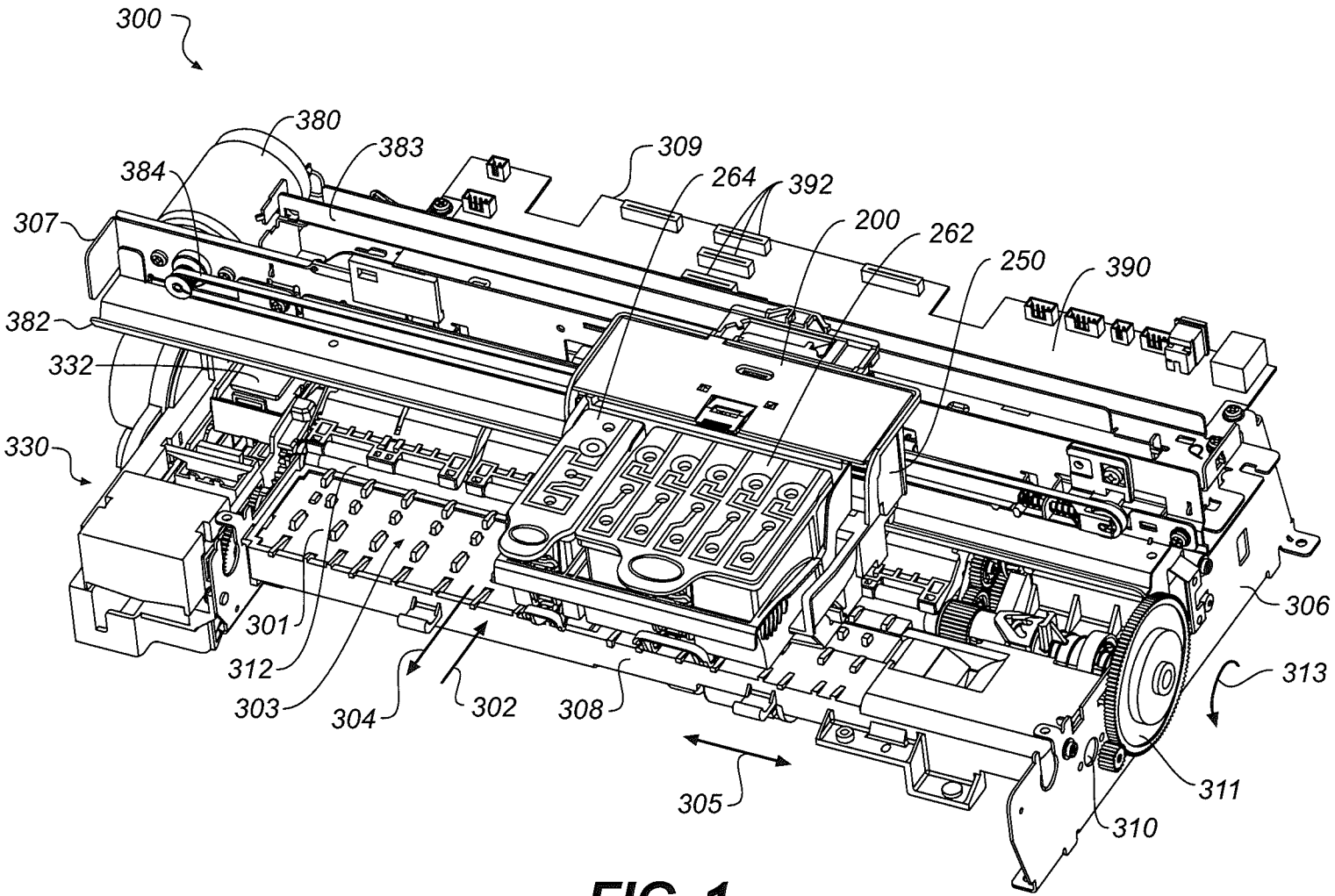
FIG. 1 is a perspective view of a portion of a carriage printer.

FIG. 1 shows a portion of a desktop carriage inkjet printer with which the present invention can be used. Some of the parts of the printer have been hidden in the view shown in FIG. 1 so that other parts can be more clearly seen. Printer chassis 300 has a platen 301 in print region 303 across which carriage 200 is moved back and forth in carriage scan direction 305 between the right side 306 and the left side 307 of printer chassis 300, while drops are ejected from printhead 250 that is mounted on carriage 200. Paper or other recording medium is held substantially flat against platen 301. Carriage motor 380 moves belt 384 to move carriage 200 along carriage guide rail 382. An encoder sensor (not shown) is mounted on carriage 200 and indicates carriage location relative to an encoder fence 383.

Multi-chamber ink tank 262, in this example, contains five ink sources: cyan, magenta, yellow, photo black and colorless protective fluid; while single-chamber ink tank 264 contains the ink source for text black for printhead 250. In other arrangements, rather than having a multi-chamber ink tank to hold several ink sources, all ink sources are held in individual single chamber ink tanks. Paper or other recording medium (sometimes generically referred to as paper or media herein) is loaded along paper load entry direction 302 toward the front of printer chassis 308.

Figure 2:
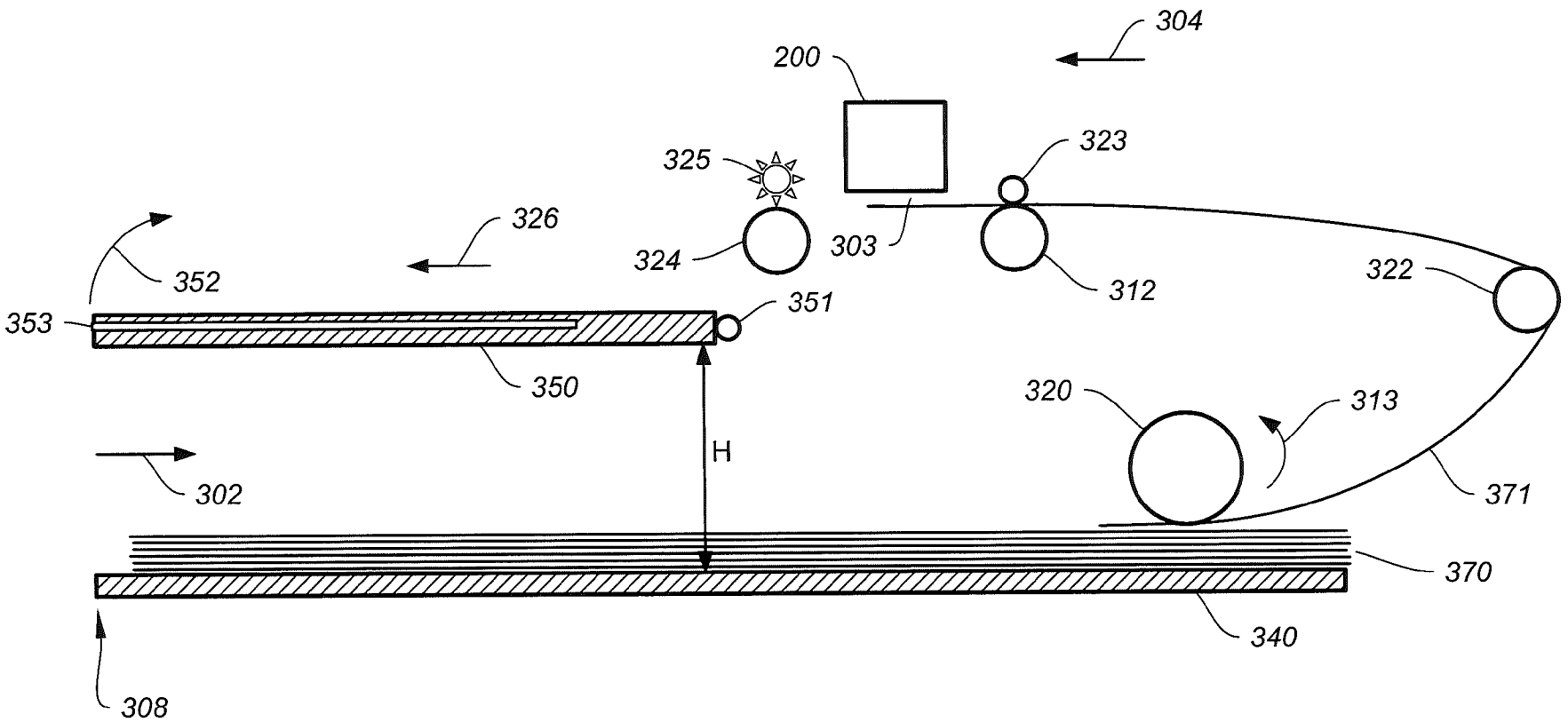
FIG. 2 is a schematic side view of an exemplary paper path in a carriage printer.

A variety of rollers are used to advance the medium through the printer as shown schematically in the side view of FIG. 2 (viewed from the right side of printer chassis 306 with reference to FIG. 1). In this example, a pick-up roller 320 moves the top piece or sheet 371 of a stack 370 of paper or other recording medium from media input tray in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 1). The paper is then moved by feed roller 312 and idler roller(s) 323 to advance across print region 303 (platen not shown), and from there to a discharge roller 324 and star wheel(s) 325 so that printed media is discharged along discharge direction 326 onto media output tray 350. Media output tray 350 is optionally provided with an extension 353 which can be retracted into media output tray 350 (as in FIG. 2) or extended along discharge direction 326 in order to provide support for longer pieces of recording medium. Media output tray 350 is mounted at a distance H above the media input tray 340. In order to provide access to media input tray 340 for loading the recording medium, media output tray 350 can be mounted with a mounting member 351 that allows movement of media output tray 350 relative to media input tray 340. In the prior art, mounting member 351 has typically been a hinge about which media output tray 350 can be pivoted along pivoting direction 352 to raise its edge near the front of printer chassis 308 to a distance from the media input tray 340 that is greater than H, while the edge near the hinge remains at a distance substantially equal to H. Embodiments of the present invention, as described below, disclose an improved mounting for media output tray 350 that enables improved access to media input tray 340 for loading the recording medium.

The motor that powers the paper advance rollers is not shown in FIG. 1, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 1, is the maintenance station 330 including a cap 332 and a wiper (not shown).

Toward the rear of the printer chassis 309, in this example, is located the electronics board 390, which includes cable connectors 392 for communicating via cables (not shown) to the carriage 200 and from there to the printhead 250. Also on the electronics board are typically mounted motor controllers for the carriage motor 380 and for the paper advance motor, a processor and/or other control electronics for controlling the printing process, and an optional connector for a cable to a host computer.

Figure 3:
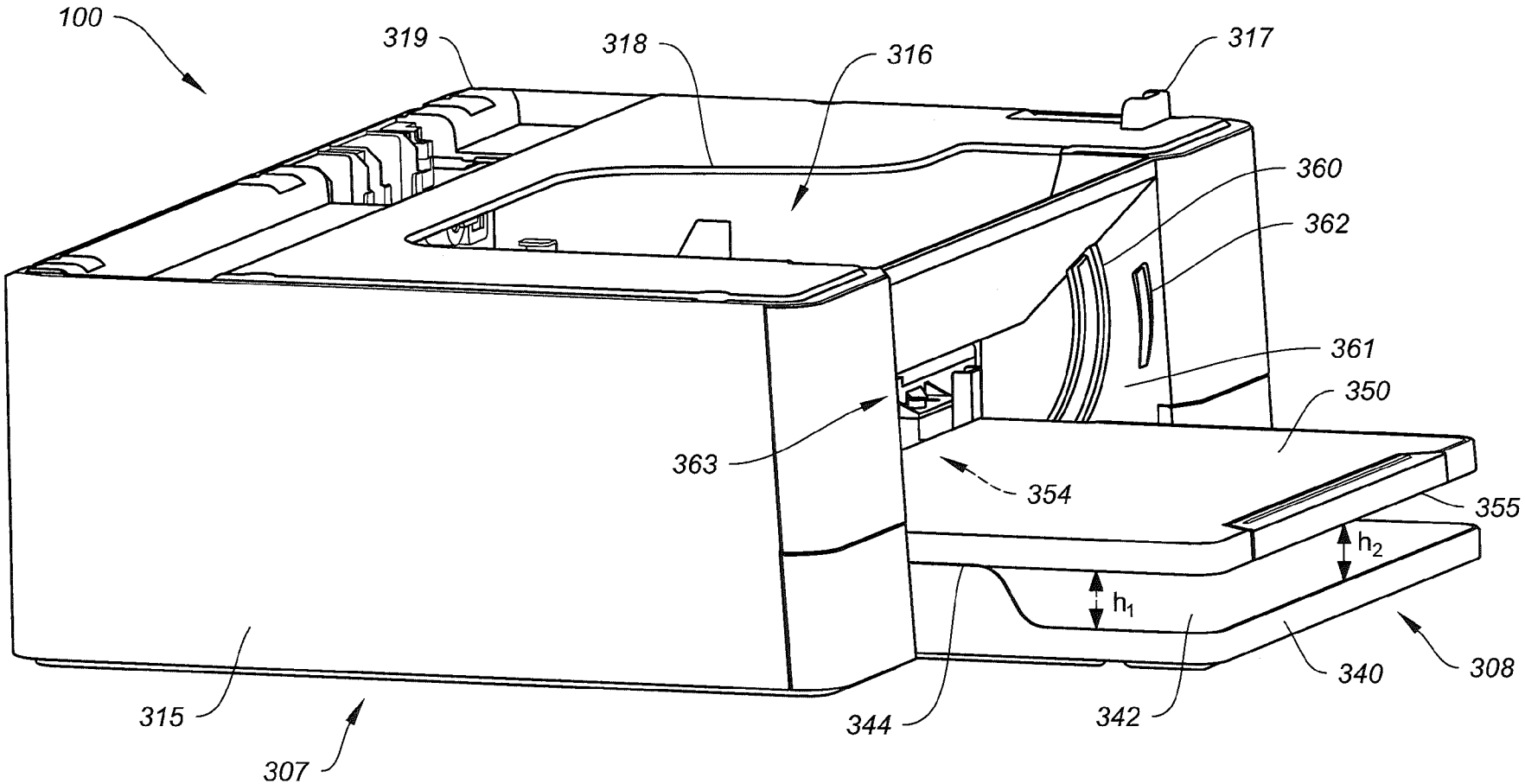
FIG. 3 is a perspective view of a printing apparatus, according to an embodiment of the invention, with the media output tray in a normal operating position.
Figure 4:
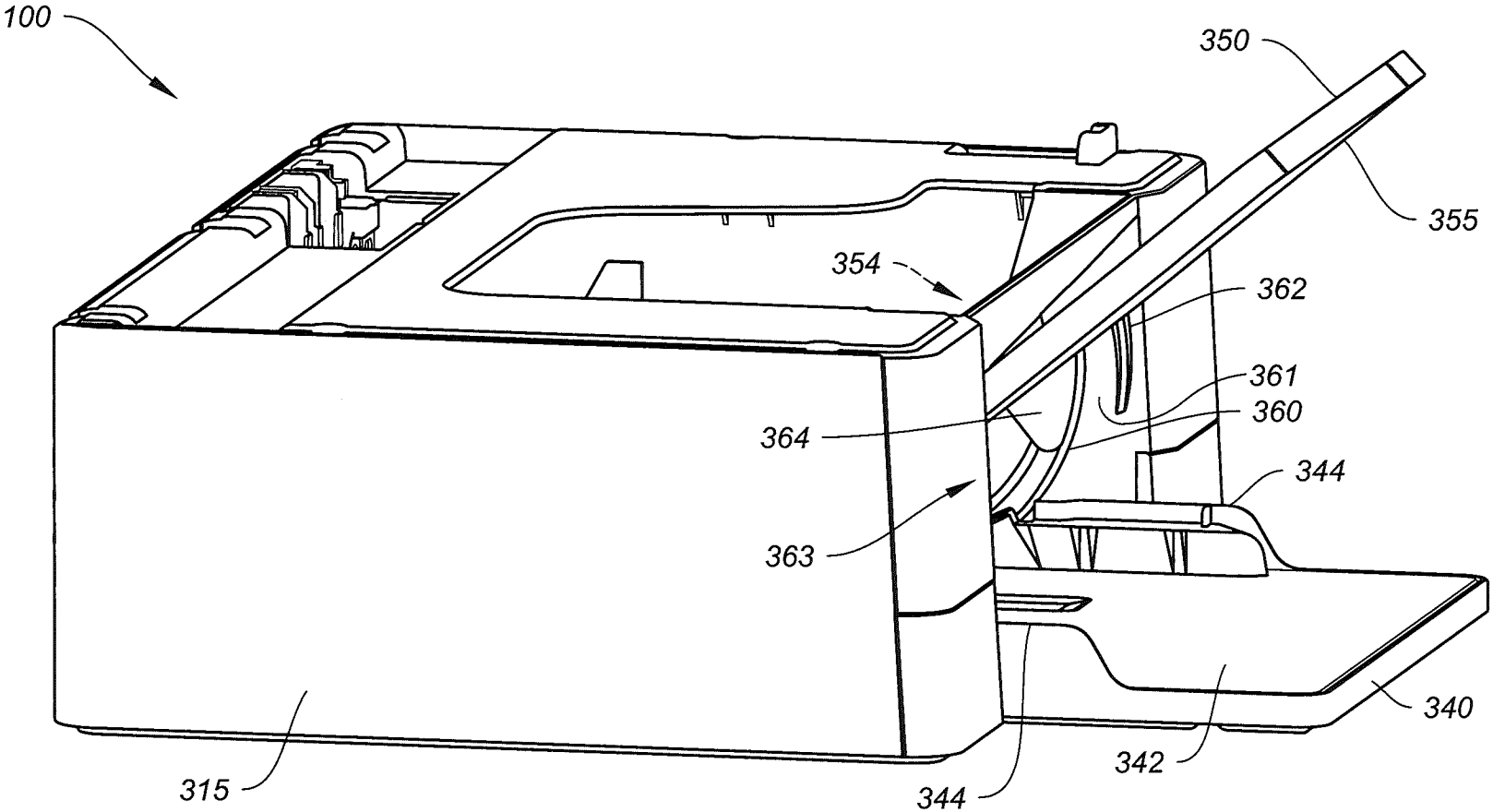
FIG. 4 is a similar view as FIG. 3, but with the media output tray raised to a media loading position.

FIG. 3 shows a perspective view of a printing apparatus 100 according to an embodiment of the invention. With reference to FIG. 1, the view is oriented toward the left side of the printer chassis 308. Printer chassis 300 is located in the interior 316 of printer housing 315 and is largely hidden in the view of FIG. 3. For a multifunction printer, a scanning apparatus (not shown) for scanning documents or other objects is typically mounted above printer housing 315 and is attached at hinge 319. Attachment member 317 aligns the front of the scanning apparatus to the printer housing 315 when the scanning apparatus is pivoted downward. When the scanning apparatus is pivoted upward, the user can change ink tanks for the printhead through access opening 318. A media input tray 340 and a media output tray 350 extend outwardly from printer housing 315 at the front of printer chassis 308. When the scanning apparatus is assembled to the printing apparatus 100, the media output tray 350 is located between the scanning apparatus and the media input tray 340 when the media output tray 350 is in its normal operating position for printing. Media output tray 350 includes a first edge 354 that extends into printer housing 315 and a second edge 355 that extends out of printer housing 315. In particular, reference character designated as 355 points at the second edge of media output tray 350 as being at the lower side of the outward extending portion of the media output tray 350. Similarly, the first edge 354 is located at the lower side of the inward extending portion of media output tray 350, and is indicated by a dashed arrow because that edge is hidden in the view of FIG. 3. In FIG. 3, the media output tray 350 is located in its operating position. In this first position, the first edge 354 is located at a first distance $h_1$ (similarly shown as a dashed arrow) from the upper surface 342 (for holding media) of media input tray 340, while the second edge 355 is shown located at a second distance $h_2$ from the upper surface 342. In this example, the operating position of media output tray 350 is parallel to media input tray 340 so that $h_1=h_2$. In other examples the trays are not parallel in the operating position. A lower surface of media output tray 350 rests on support feature 344 of media input tray 340 in order to determine the operating position of the media output tray 350. In the embodiment shown in FIG. 3, a curved track 360 is provided on wall 361 for guiding the media output tray 350 into a second position for loading media into the media input tray 340. The second position is shown in FIG. 4. A catch 362 is provided on wall 361 to hold the media output tray 350 in its second position as is described in more detail below. A similar curved track 360 and catch 362 are located on wall 363 opposite wall 361, but they are hidden from view in FIG. 3. Both curved tracks are typically formed as circular arcs with equal radii of curvature.

The view of printing apparatus 100 in FIG. 4 is similar to that of FIG. 3, but shows the media output tray 350 raised into the media loading position. A bottom surface of media output tray 350 rests on a surface of catch 362 on wall 361 (and also on the surface of catch 362 located on wall 363) to hold the media output tray in its second position for media loading into the media input tray 340. Unlike in the prior art where the rear of the media output tray is hinged for pivoting, in the example of FIGS. 3 and 4, members 365 (see FIG. 6) extend from bracket 364 into curved track 360 on wall 361, and similarly from a bracket (see FIG. 6) near wall 363 into the corresponding curved track 360. These members guide the path of media output tray 350 as both the first edge 354 and the second edge 355 are moved farther away from the media holding surface 342 of media input tray 340, thus providing improved access for media loading. Both a first and a second support feature 344 for making contact with a portion of a bottom side of media output tray 350 to hold it in the printing operational position are visible in FIG. 4.

Figure 5:
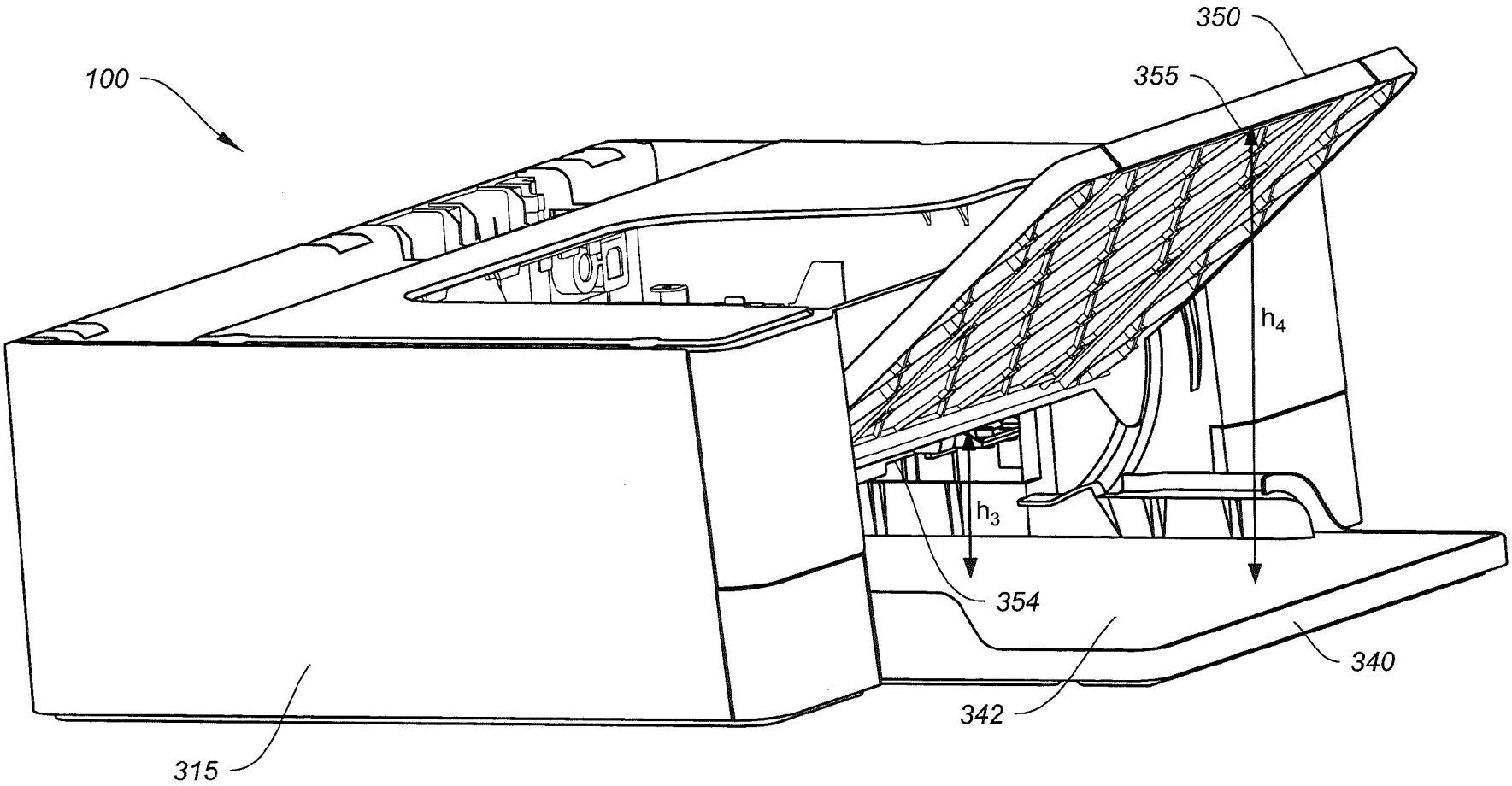
FIG. 5 is a view rotated somewhat relative to FIG. 4.

FIG. 5 is shown from a perspective that is rotated somewhat from that of FIG. 4, so that the first edge 354 of media output tray 350 can be seen more clearly. As is evident by comparing FIG. 5 to FIG. 3, in the second position (FIG. 5) of the media output tray 350 for media loading, the distance $h_3$ from the first edge 354 of media output tray 350 to surface 342 of media input tray 340 is greater than distance $h_1$ from the first edge 354 of media output tray 350 to surface 342 of media input tray 340 is when media output tray 350 is in the first position (FIG. 3) for printing operation. Similarly, in the second position (FIG. 5) of the media output tray 350 for media loading, the distance $h_4$ from the second edge 355 of media output tray 350 to surface 342 of media input tray 340 is greater than distance $h_2$ from the second edge 354 of media output tray 350 to surface 342 of media input tray 340 is when media output tray 350 is in the first position (FIG. 3) for printing operation. In addition, in the media loading position (FIG. 5) of media output tray 350, the second edge 355 is at a greater distance $h_4$ from surface 342 of media input tray 340 than the distance $h_3$ from surface 342 that first edge 354 is.

Figure 6:
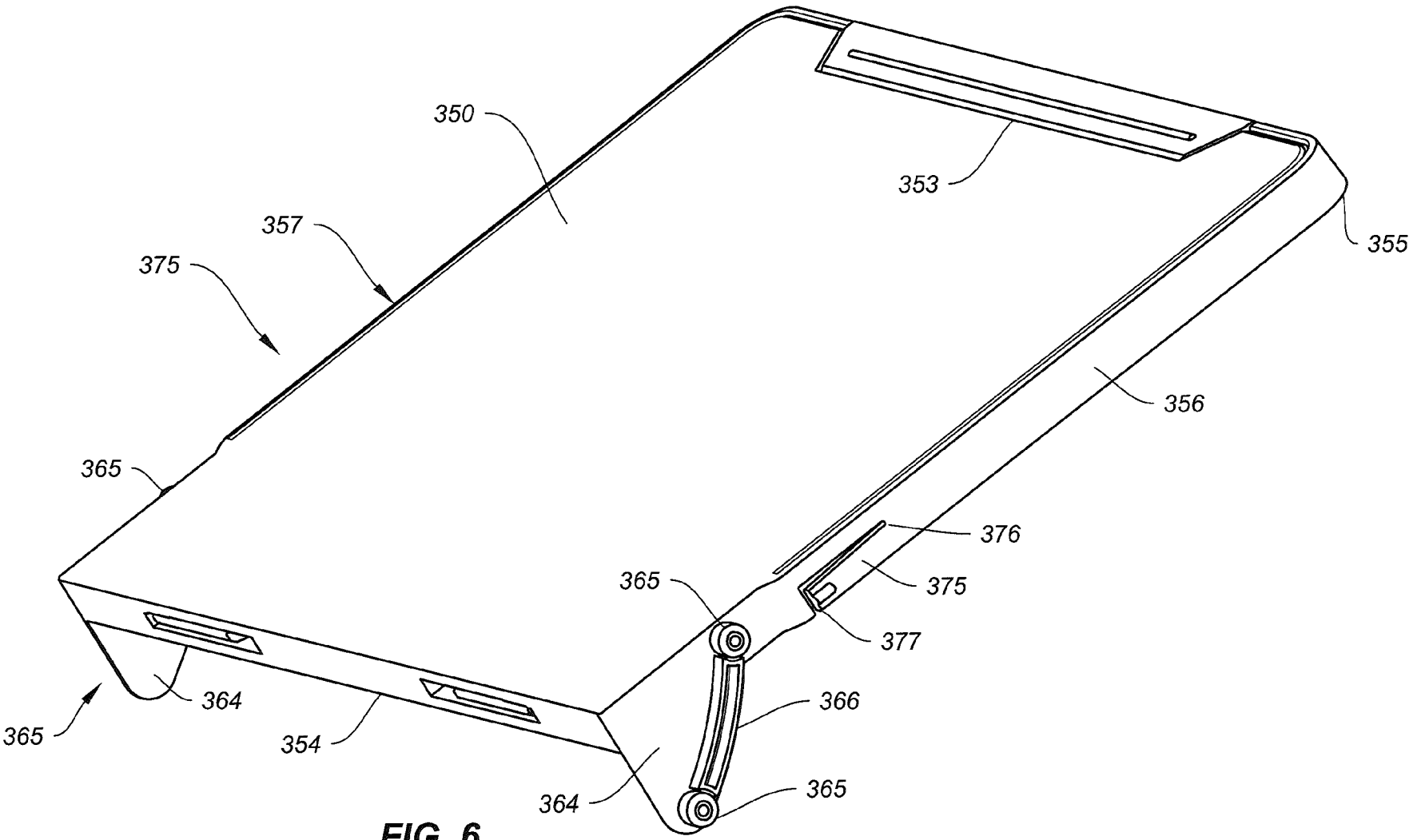
FIG. 6 is a perspective view of the media output tray according to an embodiment of the invention.

FIG. 6 shows a perspective view of media output tray 350 in isolation from the rest of the printing apparatus. Media output tray 350 includes a first wall 356 and a second wall 357 opposite first wall 356. A first bracket 364 is located on the same side as first wall 356 of media output tray 350, and a second bracket 364 is located on the same side as second wall 357 of media output tray 350. Extending from each of the two brackets 364 are two members 365 (i.e. four members 365 total). When the media output tray 350 is mounted on the printer housing as in FIGS. 3 and 4, the bracket 364 on the same side as first wall 356 of media output tray 350 is located near wall 363 of printer housing 315, and the members 365 located on that bracket 364 extend into the curved track located on wall 363. Similarly, the bracket 364 on the same side as second wall 357 of media output tray 350 is located near wall 361 of printer housing 315, and the members 365 located on that bracket 364 extend into the curved track located on wall 361. Extending between the two members 365 on each bracket 364 is a stiffening rib 366. Stiffening ribs 366 typically extend into curved tracks 360, so they preferably have substantially equal radii of curvature as the curved tracks 360, in order not to bind during raising and lowering of the media output tray 350. Extending from first wall 356 and second wall 357 of media output tray 350 are latches 375. In the example shown in FIG. 6, latches 375 are integrally formed with media output tray 350 and include a first end 376 that is affixed to the corresponding wall 356 or 357, and a second end 377 that cantilevers away from the corresponding wall 356 or 357. Such an arrangement provides a latch 375 having a home position (e.g. the position shown in FIG. 6) and a bent position in which the cantilevered second end 377 is pushed away from the home position. Slidable extension 353 of media output tray 350 near second edge 355 is seen in its retracted position in FIG. 6.

Figure 7:
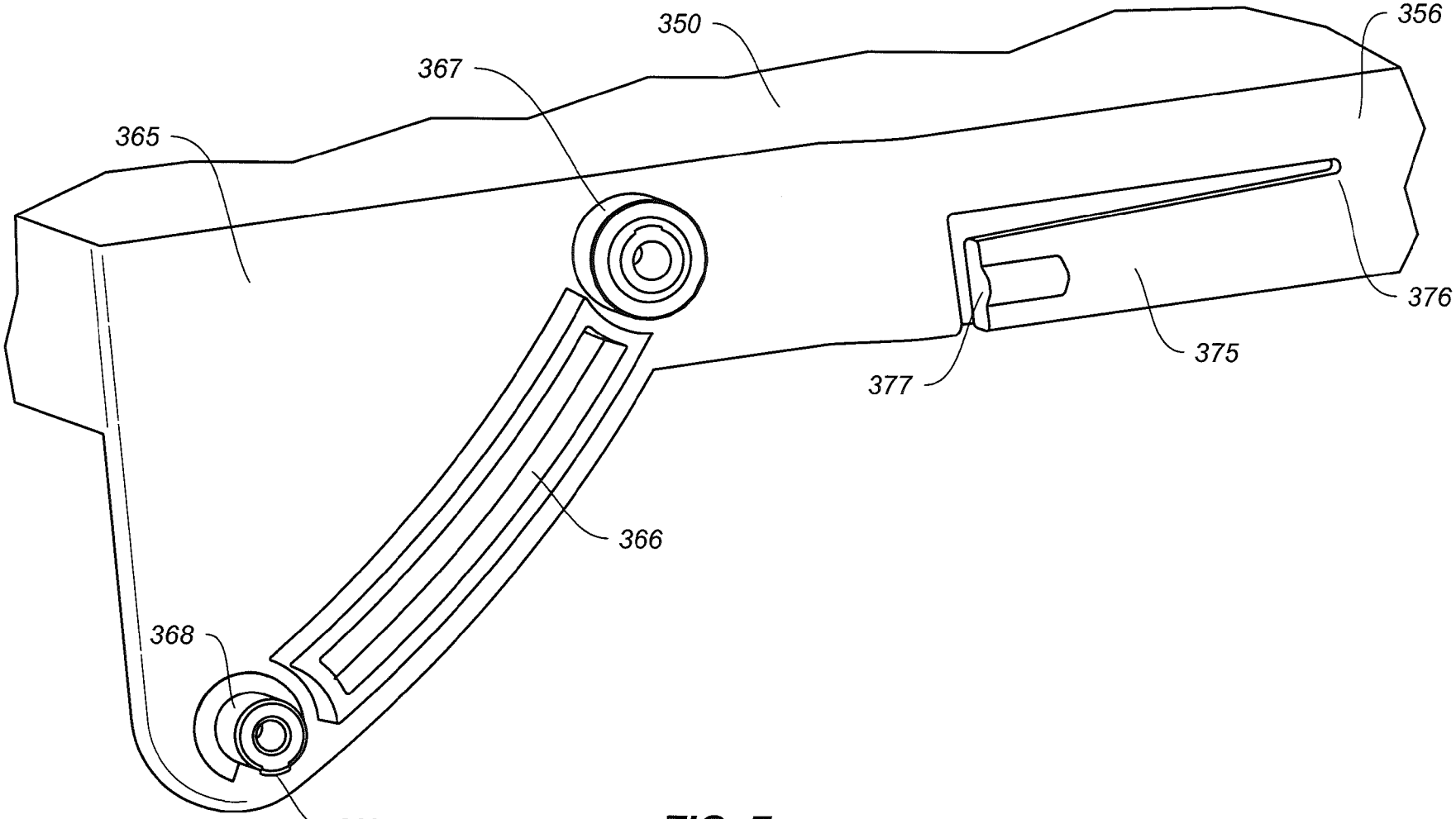
FIG. 7 is a close-up perspective view of a portion of the media output tray of FIG. 6.

FIG. 7 is a close up view of the portion of media output tray 350 near bracket 364 and latch 375 near first side 356 of media output tray 350. Members 365 can include a roller 367 rotatably mounted on an axle 368 in some embodiments. Rollers 367 can be held onto axles 368 by means of a retaining feature 369. One roller is omitted in FIG. 7 in order to show axle 368 and retaining feature 369 more clearly. Rollers 367 provide a low friction guide for output media tray 350 in curved track(s) 360 for easy operation as the media output tray 350 is raised and lowered between the positions shown in FIGS. 3 and 4. In other embodiments, pins can be used instead of rollers 367. Such pins typically look similar to axles 368 but without retaining features 369. To reduce friction between the pins and the curved track 360, the pins and/or the curved track 360 can be lubricated. Pins or axles 368 can be integrally formed with the media output tray 350 (e.g. by injection molding) or separate parts such as metal shafts can be inserted into brackets 364.

Figure 8:
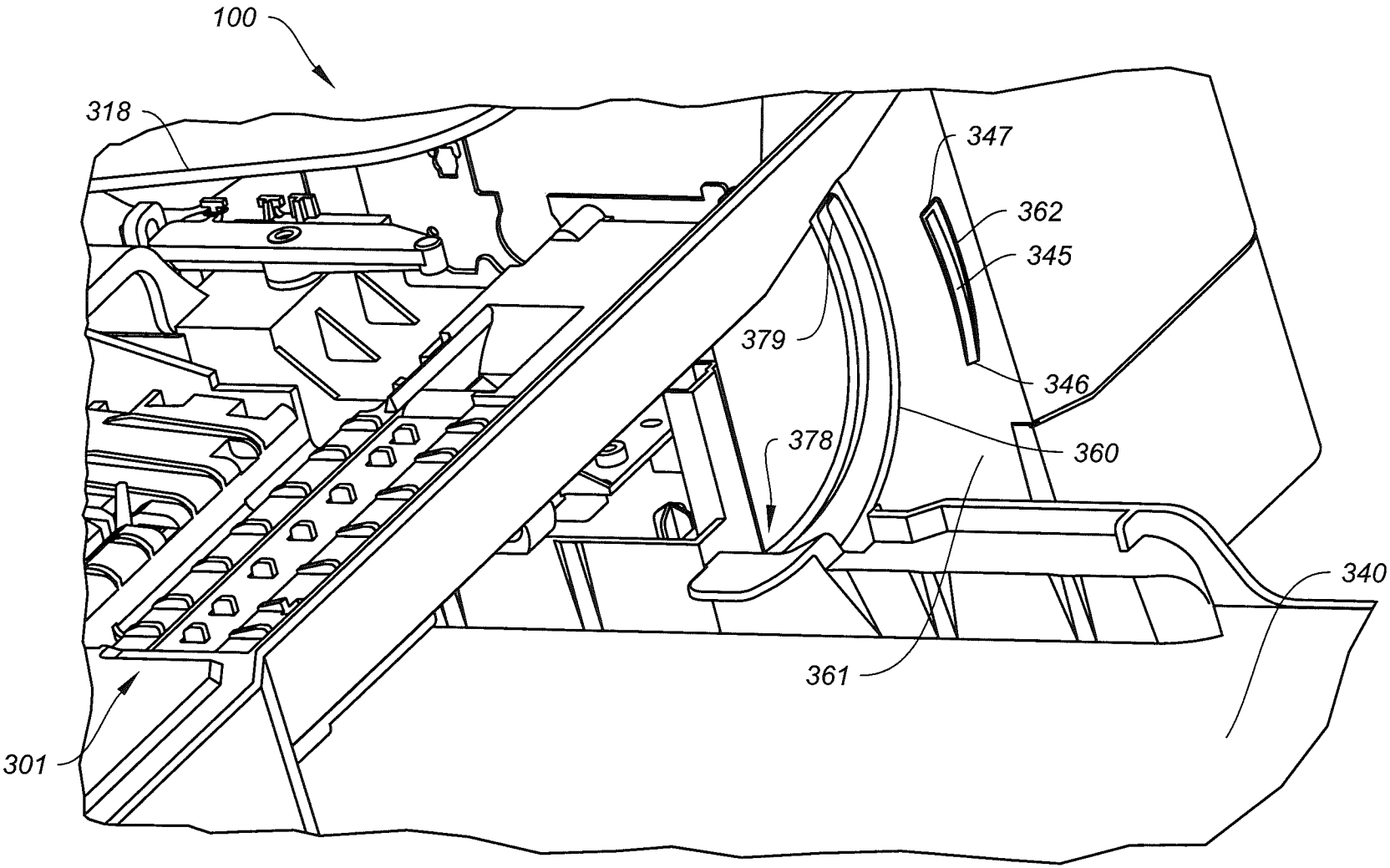
FIG. 8 is a close-up perspective view of the printing apparatus of FIG. 3 with the media output tray hidden.
Figure 9:
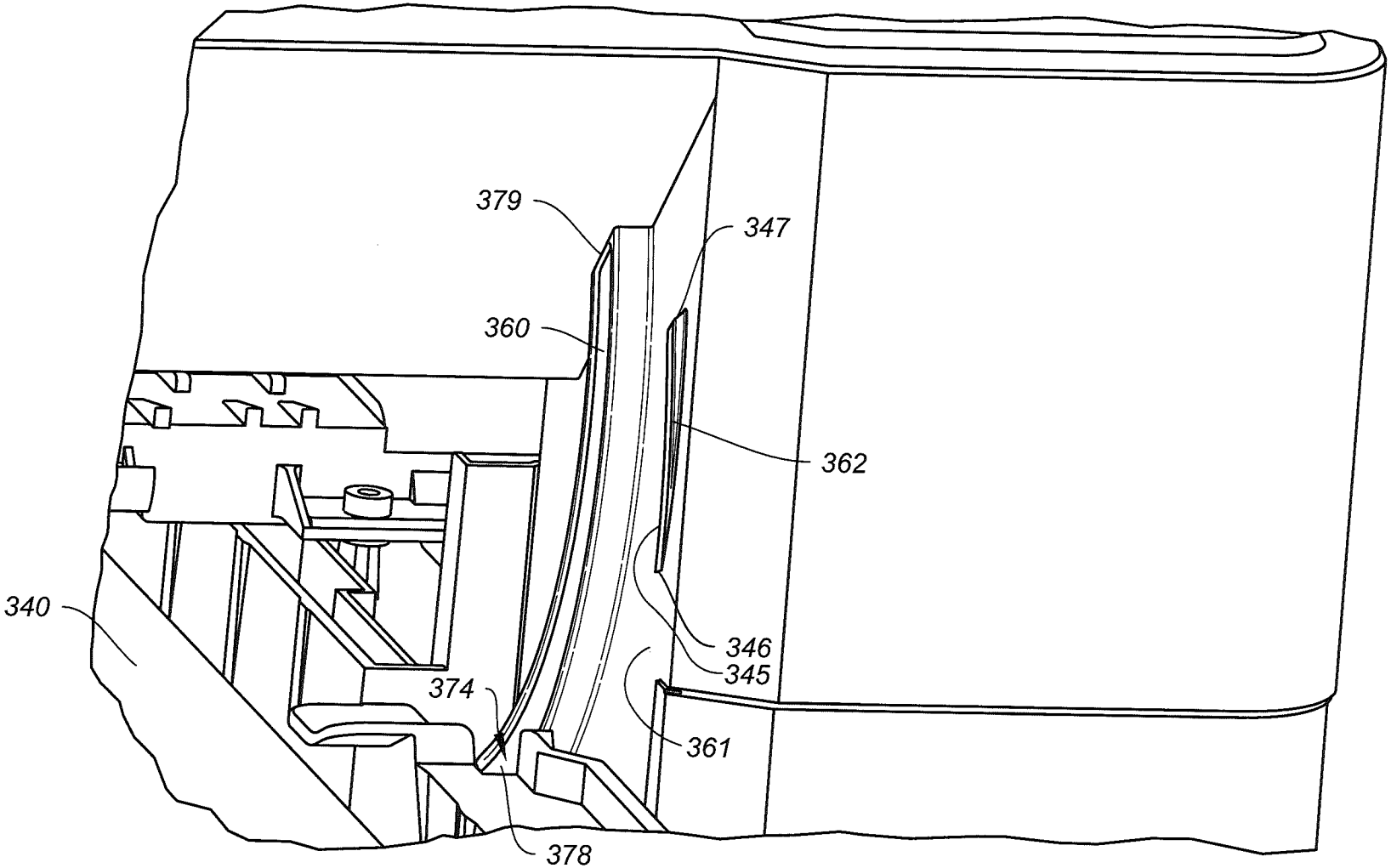
FIG. 9 is a close-up perspective view that is rotated somewhat from the view of FIG. 8.

FIG. 8 is a close-up view of a portion of printing apparatus 100 near wall 361 and curved track 360. Some parts of the printer chassis, such as platen 301, are visible through access opening 318 in this view. The media output tray is hidden in this view. Curved track 360 on wall 361 includes a first end 378 located near the media input tray 340, and a second end 379 located farther from the media input tray 340. This is similarly true of curved track 360 on wall 363 (not shown). With reference to FIG. 6, members 365 on brackets 364 extend into the curved tracks 360 and guide the path of media output tray 350 as both the first end 354 and the second end 355 are raised from the printing operation position to the media loading position of the media output tray 350. As the media output tray 350 is raised from the printing operation position to the media loading position, second end 377 of latches 375 encounter catches 362 on walls 361 and 363. As seen with reference to FIGS. 8 and 9, catch 362 on wall 361 (and similarly for catch 362 on wall 363) includes an inclined surface 345 relative to wall 361 (or wall 363 respectively). In particular, the first end 346 of catch 362 located near the media input tray 340 extends outwardly from wall 361 a small amount, while second end 347 of catch 362 located away from media output tray 340 extends from wall 361 a larger amount. In addition, catch 362 is arc shaped. As media output tray 350 is moved away from media input tray 340 with members 364 (FIG. 6) extending into curved tracks 360, latches 375 on first wall 356 and second wall 357 first encounter the first end 346 of the respective catches 362. Latches 375 thus begin to be pushed by inclined surfaces 345 away from their home positions. Because the catches are arc-shaped with similar radii of curvature as the curved tracks 360, the latches 375 continue to remain on the inclined surfaces 345 of the respective catches 362 as the media output tray 350 is raised, and the latches 375 are progressively pushed further from their home positions. Finally when the media output tray 350 is fully raised, such that latches 375 come to the second end 347 of their respective catches 362, they spring back into their home positions and support the media output tray 350 in its media loading position. After media loading is complete, the user can push the end near second edge 355 of the media output tray 350. Because second end 347 of catch 362 is also inclined, a moderate amount of downward force on that end of media output tray 350 causes the latches 375 to be bent away from their home position and onto inclined surfaces 345. The media output tray 350 is thereby lowered with moderate resistance provided by the inclined surfaces 345 against respective latches 375. A receptacle 374 is provided near the first end 378 of each of the curved tracks 360 on walls 361 and 363, so that as the media output tray 350 is lowered into its printing operation position, the first bracket 364 and the second bracket 364 extend respectively into the first receptacle 374 near wall 361 and the second receptacle 374 near wall 363.

The media output tray configuration described above facilitates easy access to the input tray for media loading in a printer having a compact design including a close spacing between the input tray and the output tray when the printer is in its operating position for printing. Because the curved tracks and catches can be integrally formed with the printer housing and because the brackets, latches and pins or axles can be integrally formed with the media output tray, the design is low cost. Furthermore since the bracket members, latches, curved tracks and catches guide the media output tray from an operating position to a media loading position, it is easy for the user to operate in a reliable fashion.

The invention has been described in detail with particular reference to certain preferred embodiments thereof, but it will be understood that variations and modifications can be effected within the spirit and scope of the invention. In particular, the invention has been described in the context of an inkjet carriage printer. However, it is also applicable to other types of printers having a media output tray.

Parts List

100 Printing apparatus
200 Carriage
250 Printhead
262 Multichamber ink tank
264 Single chamber ink tank
300 Printer chassis
301 Platen
302 Paper load entry direction
303 Print region
304 Media advance direction

305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
315 Printer housing
316 Interior (of printer housing)
317 Attachment member
318 Access opening
319 Hinge (for scanning apparatus)
320 Pick-up roller
322 Turn roller
323 Idler roller
324 Discharge roller
325 Star wheel(s)
326 Discharge direction
330 Maintenance station
332 Cap
340 Media input tray
342 Surface (of the media input tray for holding media)
344 Support feature
345 Inclined surface (of catch)
346 First end (of catch)
347 Second end (of catch)
350 Media output tray
351 Mounting member (for media output tray)
352 Pivoting direction (for prior art mounting member)
353 Extension (for media output tray)
354 First edge (of media output tray)
355 Second edge (of media output tray)
356 First wall (of media output tray)
357 Second wall (of media output tray)
360 Curved track
361 Wall
362 Catch
363 Wall
364 Bracket
365 Member (extending from bracket)
366 Stiffening rib
367 Roller
368 Axle
369 Retaining feature
370 Stack of media
371 Top piece of medium
374 Receptacle (for bracket)
375 Latch
376 First end (of latch)
377 Second end (of latch)
378 First end (of curved track)
379 Second end (of curved track)
380 Carriage motor
382 Carriage guide rail
383 Encoder fence
384 Belt
390 Printer electronics board
392 Cable connectors

The invention claimed is:

1. A printing apparatus comprising:

a media input tray including a surface for holding media;

a first wall including a first curved track; and a second wall opposite the first wall, the second wall including a second curved track; and a media output tray including a first edge and a second edge opposite the first edge, the media output tray comprising:

a first position such that the first edge is located at a first distance $h_1$ from the surface of the media input tray and the second edge is located at a second distance $h_2$ from the surface of the media input tray;

a second position such that the first edge is at a third distance $h_3$ from the surface of the media input tray and the second edge is located at a fourth distance $h_4$ from the surface of the media input tray, wherein $h_4 > h_2$ $h_4 > h_3$, and $h_3 > h_1$;

a first bracket located proximate the first wall, the first bracket including a first member and a second member extending into the first curved track; and a second bracket located proximate the second wall, the second bracket including a third member and a fourth member that extend into the second curved track.

2. The printing apparatus of claim 1, where in the first position of the media output tray, $h_1$ is substantially equal to $h_2$.

3. The printing apparatus of claim 1 further comprising a housing, wherein the first edge of the media output tray extends into the housing and the second edge of the media output tray extends out of the housing.

4. The printing apparatus of claim 3, the media output tray further comprising a slidable extension disposed proximate the second edge of the media output tray.

5. The printing apparatus of claim 1, wherein the first and second curved tracks are substantially circular arcs having equal radii of curvature.

6. The printing apparatus of claim 1, each of the first and second curved tracks including a first end and a second end, the first end being located proximate to the media input tray, and the second end being located distal to the media input tray.

7. The printing apparatus of claim 1, wherein the first member, second member, third member and fourth member each comprise a pin.

8. The printing apparatus of claim 1, wherein the first member, second member, third member and fourth member each comprise a roller that is rotatably mounted on an axle.

9. The printing apparatus of claim 8, wherein each of the four axles includes a retaining feature for retaining the corresponding roller.

10. The printing apparatus of claim 1, further comprising a first stiffening rib extending between the first member and the second member, and a second stiffening rib extending between the third member and the fourth member.

11. The printing apparatus of claim 10, wherein the first stiffening rib, the second stiffening rib, the first curved track and the second curved track have substantially equal radii of curvature.

12. The printing apparatus of claim 1 further comprising a first support feature and a second support feature with which a portion of a bottom side of the media output tray makes contact when the media output tray is disposed in its first position.

13. The printing apparatus of claim 1 further comprising:

a first wall including a first curved track having a first end located proximate to the media input tray;

a second wall opposite the first wall, the second wall including a second curved track having a first end located proximate to the media input tray:

a first receptacle located proximate to the first end of the first curved track; and a second receptacle located proximate to the first end of the second curved track, wherein the media output tray further comprises a first bracket that extends into the first receptacle and a second bracket that extends into the second receptacle when the media output tray is in its first position.

14. The printing apparatus of claim 1 further comprising a scanning apparatus for scanning documents, wherein the media output tray is located between the scanning apparatus and the media input tray when the media output tray is in its first position.

15. A printing apparatus comprising:

a media input tray including a surface for holding media;

a first wall including a first catch; and a second wall including a second catch, a media output tray including a first edge and a second edge opposite the first edge, the media output tray comprising:

a first position such that the first edge is located at a first distance $h_1$ from the surface of the media input tray and the second edge is located at a second distance $h_2$ from the surface of the media input tray; and a second position such that the first edge is at a third distance $h_3$ from the surface of the media input tray and the second edge is located at a fourth distance $h_4$ from the surface of the media input tray, wherein $h_4 > h_2$, $h_4 > h_3$, and $h_3 > h_1$;

wherein the media output tray includes a first latch to engage the first catch and a second latch to engage the second catch when the media output tray is disposed in its second position;

wherein the media output tray includes a first wall and a second wall opposite the first wall, wherein the first latch includes a first end that is affixed to the first wall and a second end that is cantilevered from the first wall, and wherein the second latch includes a first end that is affixed to the second wall and a second end that is cantilevered from the second wall.

16. The printing apparatus of claim 15 wherein the first catch includes a first surface that is inclined relative to the first wall, and the second catch includes a second surface that is inclined relative to the second wall.

17. The printing apparatus of claim 16, wherein the first catch and the second catch are arc-shaped.

* * * * *